US009381131B2

(12) United States Patent
Ota et al.

(10) Patent No.: US 9,381,131 B2
(45) Date of Patent: Jul. 5, 2016

(54) PHYSICAL ASSISTIVE ROBOTIC SYSTEMS

(71) Applicants: Toyota Motor Engineering & Manufacturing North America, Inc., Erlanger, KY (US); Illinois Institute of Technology, Chicago, IL (US)

(72) Inventors: Yasuhiro Ota, Union, KY (US); Masaru Ryumae, Union, KY (US); Keiichi Sato, Chicago, IL (US); Shin Sano, Oak Park, IL (US)

(73) Assignees: Toyota Motor Engineering & Manufacturing North America, Inc., Erlanger, KY (US); Illinois Institute of Technology, Chicago, IL (US)

( * ) Notice: Subject to any disclaimer, the term of this patent is extended or adjusted under 35 U.S.C. 154(b) by 596 days.

(21) Appl. No.: 13/738,508

(22) Filed: Jan. 10, 2013

(65) Prior Publication Data

US 2013/0110015 A1 May 2, 2013

Related U.S. Application Data

(62) Division of application No. 12/847,640, filed on Jul. 30, 2010, now Pat. No. 8,375,484.

(51) Int. Cl.

| | |
|---|---|
| ***A61G 7/00*** | (2006.01) |
| ***A61H 1/00*** | (2006.01) |
| ***A61G 7/10*** | (2006.01) |

(52) U.S. Cl.

CPC ..... *A61H 1/001* (2013.01); *A61G 7/1017* (2013.01); *A61G 7/1019* (2013.01); *A61G 7/1048* (2013.01); *A61G 7/1086* (2013.01); *A61G 2200/34* (2013.01); *A61G 2200/36* (2013.01); *A61G 2203/16* (2013.01); *A61G 2203/20* (2013.01); *A61G 2203/22* (2013.01); *A61G 2203/32* (2013.01)

(58) Field of Classification Search

CPC ..... A61G 7/00; A61G 5/14
USPC ..... 5/81.1 R, 83.1, 84.1, 86.1, 89.1
See application file for complete search history.

(56) References Cited

U.S. PATENT DOCUMENTS

| | | | | |
|---|---|---|---|---|
| 3,165,314 | A * | 1/1965 | Clearman et al. | 482/68 |
| 3,629,880 | A | 12/1971 | van Rhyn | |
| 4,985,947 | A | 1/1991 | Ethridge | |
| 5,502,851 | A | 4/1996 | Costello | |
| 6,357,064 | B1 | 3/2002 | Totsky | |
| 6,446,742 | B1 | 9/2002 | Wilson | |
| 6,742,206 | B1 | 6/2004 | Han | |

(Continued)

FOREIGN PATENT DOCUMENTS

| | | | |
|---|---|---|---|
| JP | H09154897 | A | 6/1997 |
| JP | 2000024062 | A | 1/2000 |

(Continued)

*Primary Examiner* — Fredrick Conley
(74) *Attorney, Agent, or Firm* — Dinsmore & Shohl LLP

(57) ABSTRACT

A physical assistive robotic device may include a frame including an upright support member, a lateral member slidably engaged with the upright support member, a handle slidably engaged with the lateral member, an elevation actuator coupled to the upright support member and the lateral member, and a lateral actuator coupled to the lateral member and the handle. The elevation actuator translates the lateral member and the lateral actuator translates the handle to transition a user between a standing position and a non-standing position.

19 Claims, 8 Drawing Sheets

(56) References Cited

U.S. PATENT DOCUMENTS

| | | | | |
|---|---|---|---|---|
| 6,917,854 | B2 | 7/2005 | Bayer | |
| 7,392,554 | B1 | 7/2008 | Su et al. | |
| 7,543,876 | B1 | 6/2009 | Egan | |
| 2008/0066228 | A1 | 3/2008 | Kume et al. | |
| 2008/0161672 | A1 | 7/2008 | Marar | |
| 2008/0180267 | A1 | 7/2008 | Kaneko et al. | |
| 2009/0144895 | A1 | 6/2009 | Bostelman et al. | |
| 2010/0154117 | A1* | 6/2010 | Odashima et al. | 5/87.1 |

FOREIGN PATENT DOCUMENTS

| | | | |
|---|---|---|---|
| JP | 2000157585 | A | 6/2000 |
| JP | 2001187096 | A | 7/2001 |
| JP | 3113742 | | 12/2004 |
| JP | 2007301071 | A | 11/2007 |
| JP | 2008180652 | A | 8/2008 |
| JP | 4312253 | B1 | 8/2009 |
| JP | 2009247411 | A | 10/2009 |
| JP | 2010094223 | A | 4/2010 |

* cited by examiner

PHYSICAL ASSISTIVE ROBOTIC SYSTEMS

CROSS-REFERENCE TO RELATED APPLICATIONS

This application is a Divisional of U.S. patent application Ser. No. 12/847,640 filed Jul. 30, 2010.

TECHNICAL FIELD

The present specification generally relates to devices and systems for physical assistance and, more specifically, devices and systems for providing mobility to individuals with a condition that restricts sitting, standing or walking.

BACKGROUND

Physically impaired people may require physical assistance in sitting, standing, and walking. Since sitting, standing, and walking motions are repeated throughout the day, the mobility assistance may require the services of a caregiver for extended periods of time. Therefore, caregivers often are employed to offer mobility assistance throughout the day. Such assistance is beneficial, but care may be limited by economic restraints such as a shortage of caregivers or the expense of hiring a caregiver. Additionally, caregiver mobility assistance may be limited to certain time of day, for example a nine to five work week. Furthermore, physically assisting patients for prolonged periods of time may lead to physical and emotional strains on caregivers, such a fatigue, injuries or depression.

Accordingly, a need exists for alternative devices and systems for providing mobility to individuals with physical impairments that restrict sitting, standing or walking.

SUMMARY

In one embodiment, a physical assistive robotic device may include: a frame including an upright support member; a lateral member slidably engaged with the upright support member; a handle slidably engaged with the lateral member; an elevation actuator coupled to the upright support member and the lateral member; and a lateral actuator coupled to the lateral member and the handle. The elevation actuator translates the lateral member and the lateral actuator translates the handle to transition a user between a standing position and a non-standing position.

In another embodiment, a physical assistive robotic system may include: an electronic control unit including a processor for executing machine readable instructions and an electronic memory for storing the machine readable instructions; a frame including an upright support member; a drive wheel rotatably coupled to the frame; a drive motor coupled to the drive wheel; a lateral member slidably engaged with the upright support member; a handle slidably engaged with the lateral member; a lateral actuator coupled to the lateral member and the handle and communicatively coupled with the electronic control unit; and an elevation actuator coupled to the upright support member and the lateral member and communicatively coupled with the electronic control unit. The electronic control unit may execute the machine readable instructions to: retrieve at least one user parameter from a database stored in the electronic memory; set an adjustable elevation rate based at least in part upon at least one user parameter; and cause the elevation actuator to translate the lateral member according to the adjustable elevation rate to transition a user between a standing position and a non-standing position.

In yet another embodiment, a physical assistive robotic system may include: an electronic control unit including a processor for executing machine readable instructions and an electronic memory for storing the machine readable instructions; a frame comprising a upright support member; a drive wheel rotatably coupled to the frame; a support wheel rotatably coupled to the frame; a drive motor coupled to the drive wheel and communicatively coupled with the electronic control unit; and a force sensing device communicatively coupled with the electronic control unit. The electronic control unit may execute the machine readable instructions to: set a cooperative mode or an autonomous mode; cause the drive motor to rotate the drive wheel based at least in part upon a steering force detected by the force sensing device when the physical assistive robotic system is operated in the cooperative mode; and cause the drive motor to rotate the drive wheel to autonomously propel the physical assistive robotic system when the physical assistive robotic system is operated in the autonomous mode.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
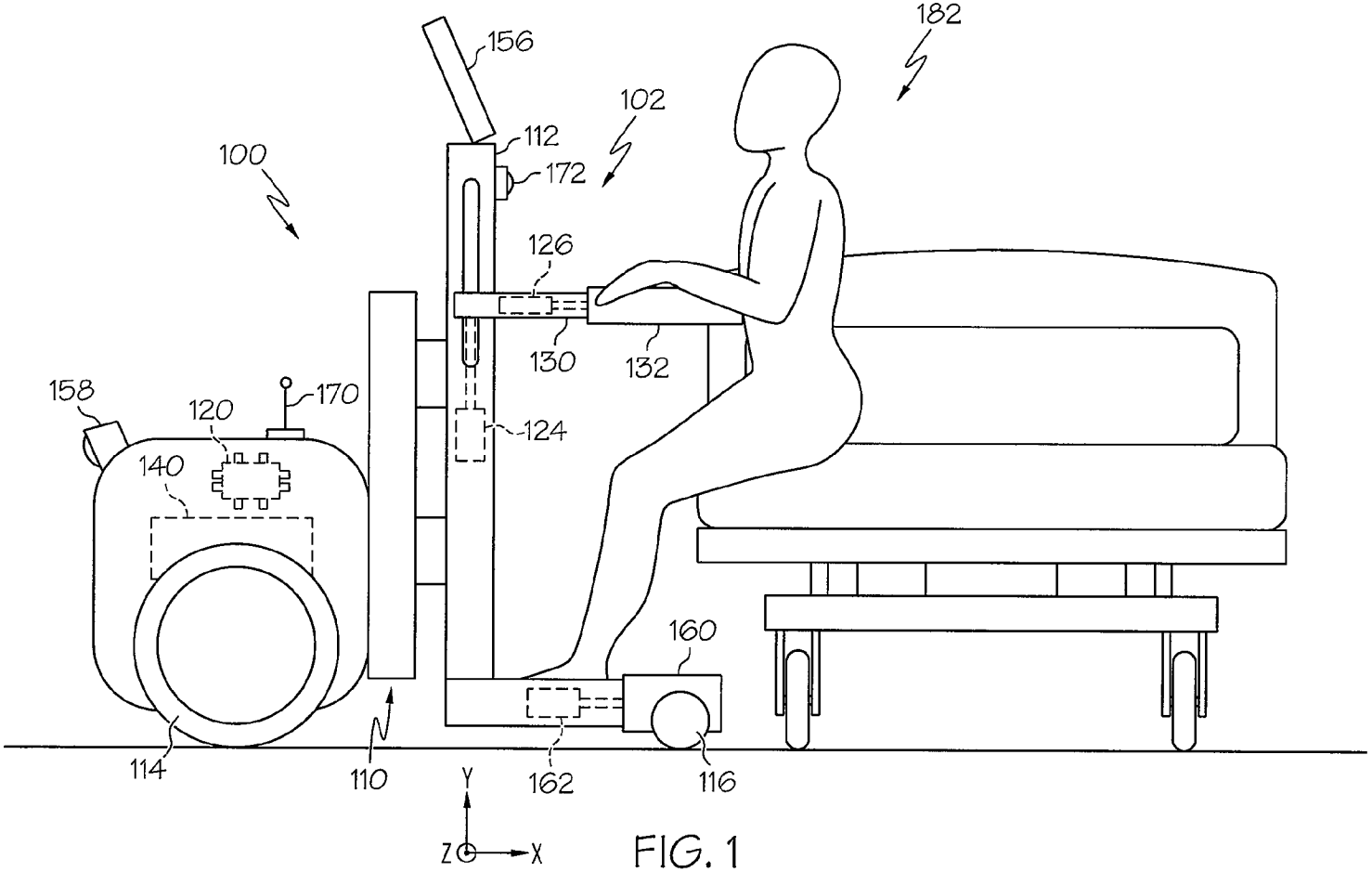
FIG. 1 schematically depicts a side view of a physical assistive robotic device according to one or more embodiments shown and described herein.

FIG. 1 generally depicts one embodiment of a physical assistive robotic system. The physical assistive robotic system generally comprises a physical assistive robotic device and an electronic control unit. The physical assistive robotic device generally comprises a frame and a user lifting member. The electronic control unit actuates the user lifting member with respect to the frame to transition a user between a standing position and a non-standing position. Various embodiments of the physical assistive robotic device and physical assistive robotic system will be described in more detail herein.

Embodiments described herein may assist a user to transition between a non-standing and a standing position. Other embodiments may promote walking by providing a cooperative mode and an autonomous mode that guides a user to a destination. Further embodiments may provide additional mobility via an autonomous device that carries a user to a desired destination.

Referring now to FIG. 1, an embodiment of a physical assistive robotic device 100 is schematically depicted. The physical assistive robotic device 100 generally comprises a frame 110, and a user lifting member 102. The frame 110 comprises an upright support member 112 that extends the frame 110 substantially vertically. The frame 110 forms the base structure of the physical assistive robotic device 100 and comprises a rigid material, such as, for example, a metal, a plastic, or a composite material. It is noted that, while the frame 110 is depicted as being formed with many right angles, the frame 110 may have any geometry that provides a suitable base for the operation of the physical assistive robotic device 100, as will be described in more detail hereinafter. Further, it should be understood that the upright support member 112 may be cambered, bent, or curved in a non-vertical manner, so as to depart from a truly vertical orientation without departing from the scope of the present disclosure.

Figure 3A:
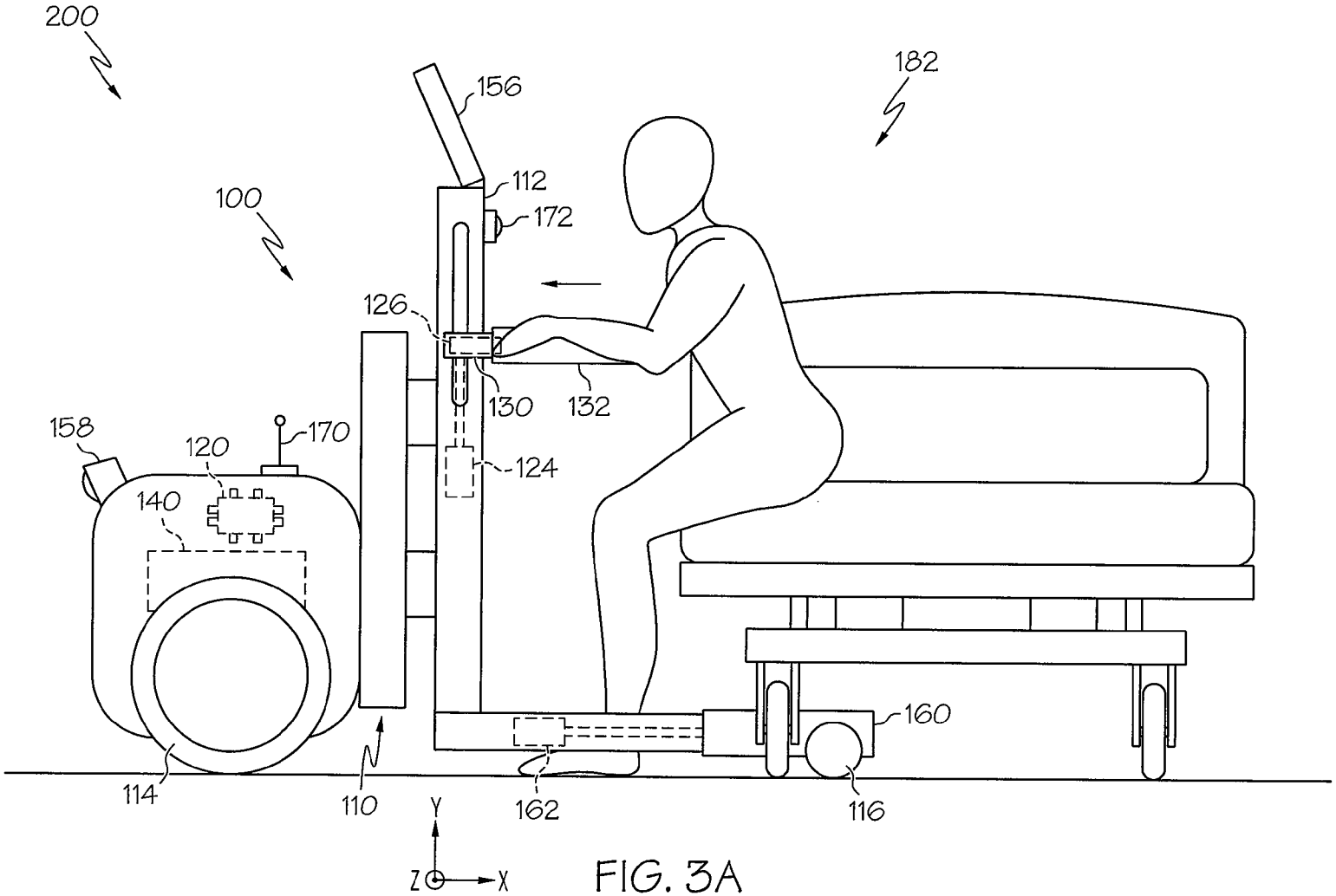
FIG. 3A schematically depicts a side view of a physical assistive robotic device according to one or more embodiments shown and described herein.
Figure 3B:
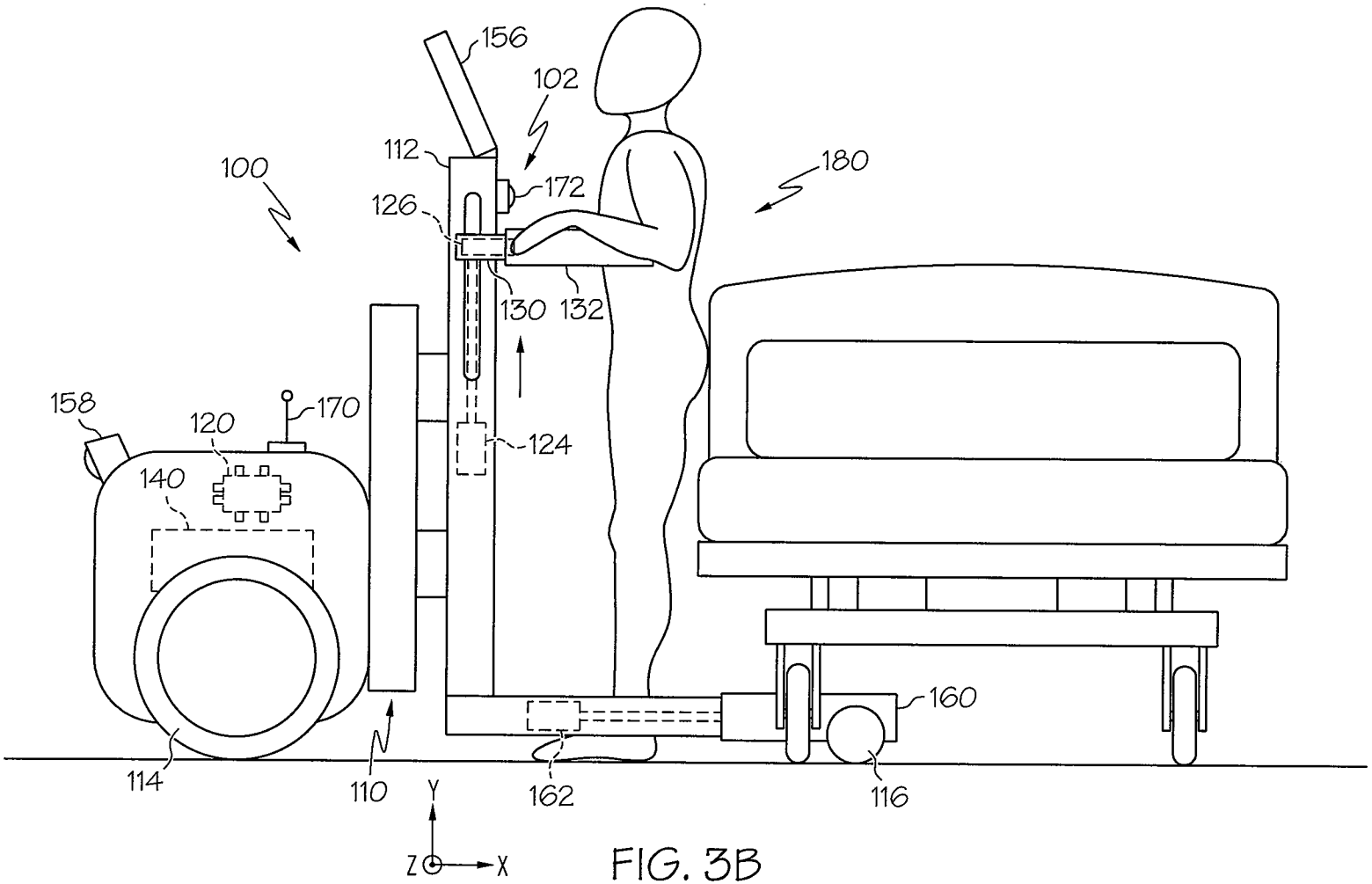
FIG. 3B schematically depicts a side view of a physical assistive robotic device according to one or more embodiments shown and described herein.
Figure 3C:
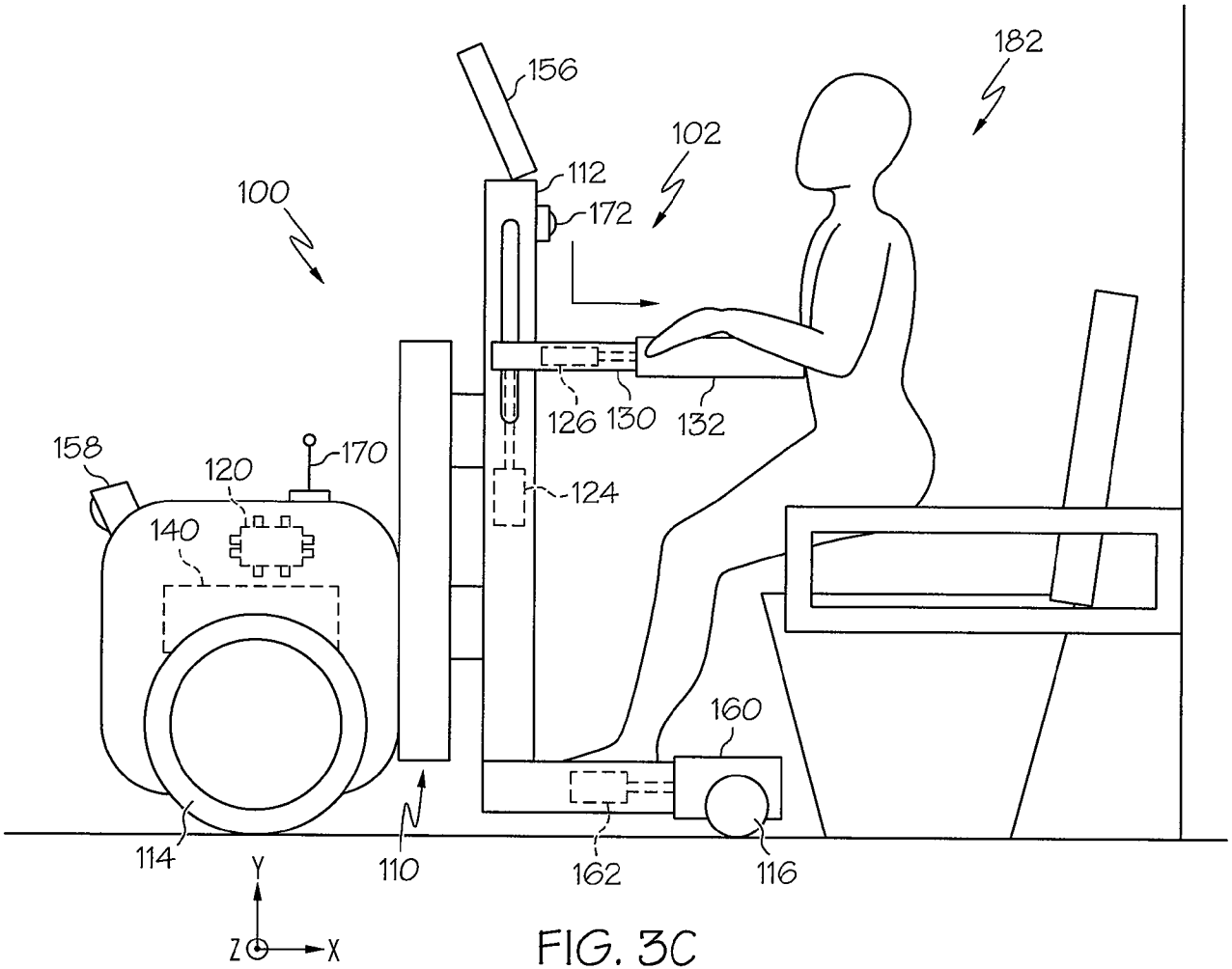
FIG. 3C schematically depicts a side view of a physical assistive robotic device according to one or more embodiments shown and described herein.

Referring still to FIG. 1, in embodiments described herein, the user lifting member 102 comprises a lateral member 130, a handle 132, an elevation actuator 124 and a lateral actuator 126. The elevation actuator 124 translates the lateral member 130 and the lateral actuator 126 translates the handle 132 to transition a user between a standing position 180 (FIG. 3B) and a non-standing position 182. The lateral member 130 is slidably engaged with the upright support member 112, and the handle 132 is slidably engaged with the lateral member 130. The lateral member 130 and the handle 132 project away from the upright support member 112. The elevation actuator 124 is coupled to the upright support member 112 and the lateral member 130. The lateral actuator 126 is coupled to lateral member 130 and the handle 132. For example, the elevation actuator 124 may be a linear motor having a drive motor coupled to the upright support member 112 and an extension arm coupled to the lateral member 130. Similarly, the lateral actuator 126 may be a linear motor having a drive motor coupled to lateral member 130 and an extension arm coupled to the handle 132. In additional embodiments, the linear motors may be coupled in a reversed orientation. As used herein, the term "actuator" means any servo-mechanism that supplies and transmits a measured amount of energy for the operation of another mechanism, such as a mechanical linkage, an electromechanical system, an electric motor, a hydraulic mechanism, a pneumatic mechanism, and the like. Thus, while described as a linear motor, the elevation actuator 124, the lateral actuator 126, and any other actuator described herein may be configured as any type of servo-mechanism.

Furthermore, it is noted that the term "translate" as used herein means to move or slide without substantial rotation or substantial angular displacement. For example, in embodiments described herein, the elevation actuator 124 translates the lateral member 130 in a positive or negative y-axis direction and the lateral actuator 126 translates the handle 132 in a positive or negative y-axis direction. However, it is noted, that the coordinate axes, provided herein, are for descriptive purposes. Therefore, the translations described herein are not limited to any specific coordinate axis.

Figure 2:
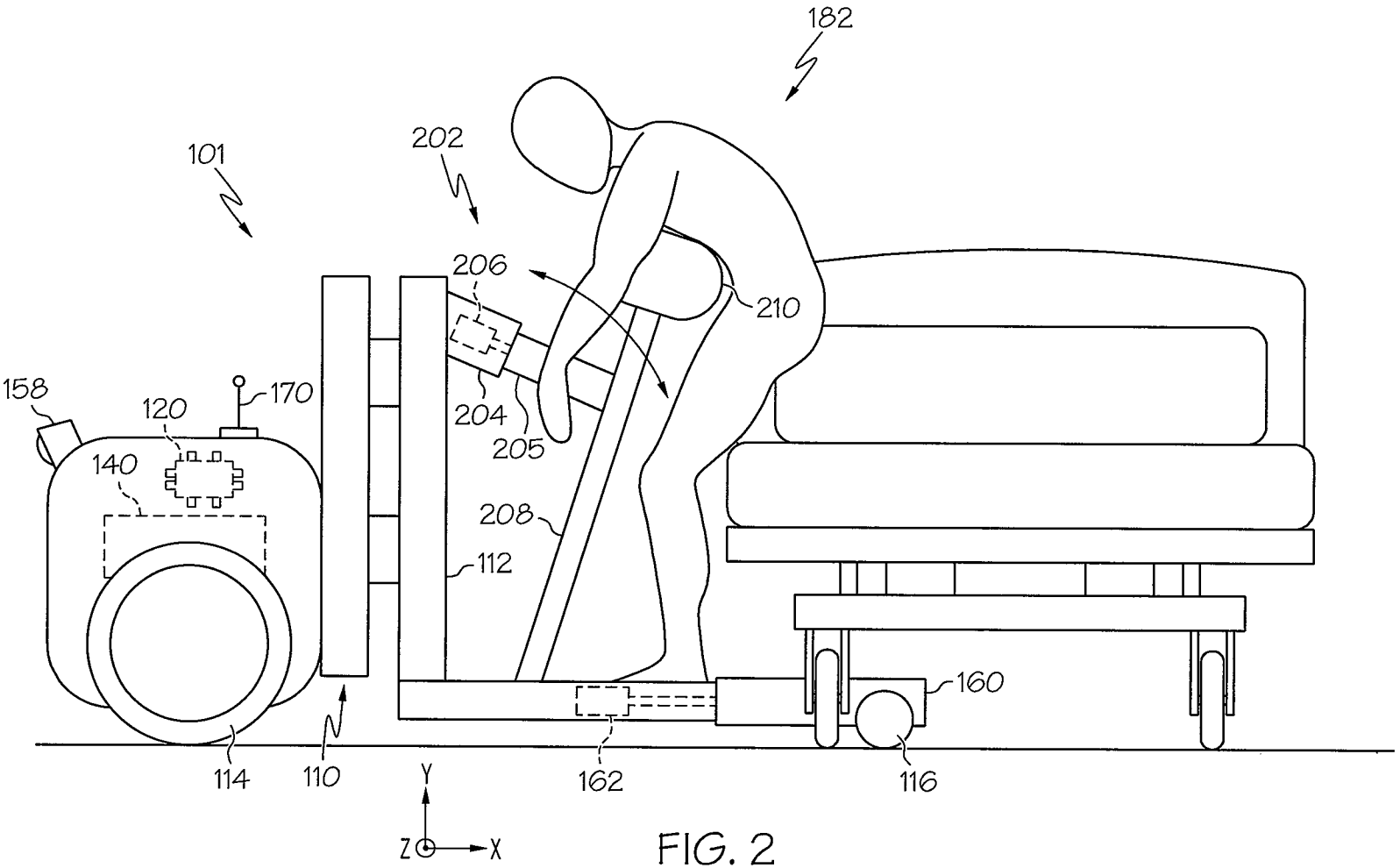
FIG. 2 schematically depicts a side view of a physical assistive robotic device according to one or more embodiments shown and described herein.

In an alternative embodiment of the physical assistive robotic device 101, depicted schematically in FIG. 2, the user lifting member 202 utilizes rotational motion rather than translational motion. The user lifting member 202 rotates about the z-axis to transition a user between a standing position 180 (FIG. 3B) and a non-standing position 182. The user lifting member 202 comprises a lateral rotation housing 204, lateral rotation member 205, a rotation actuator 206, a radial support member 208, and a torso support member 210. The radial support member 208 is rotatably engaged with the frame 110 and projects from the frame 110 vertically to the torso support member 210, which is contoured to support the torso of a user. The radial support member 208 is coupled to the lateral rotation member 205. The lateral rotation member 205 projects from the radial support member 208 and is slidably engaged with the lateral rotation housing 204. The lateral rotation housing 204 is rotatably engaged to the upright support member 112 and coupled to the rotation actuator 206. The rotation actuator 206 is also coupled to the lateral rotation member 205 and rotates the radial support member 208 to transition a user between a standing position 180 (FIG. 3B) and a non-standing position 182. In some embodiments, the torso support member 210 is padded for comfortable use.

Figure 5:
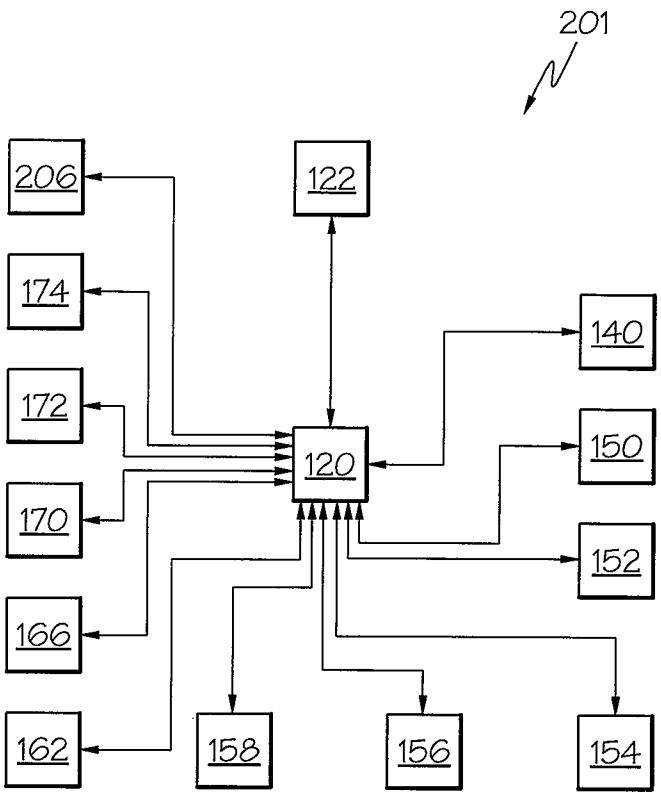
FIG. 5 schematically depicts a schematic of a physical assistive robotic system according to one or more embodiments shown and described herein.
Figure 4:
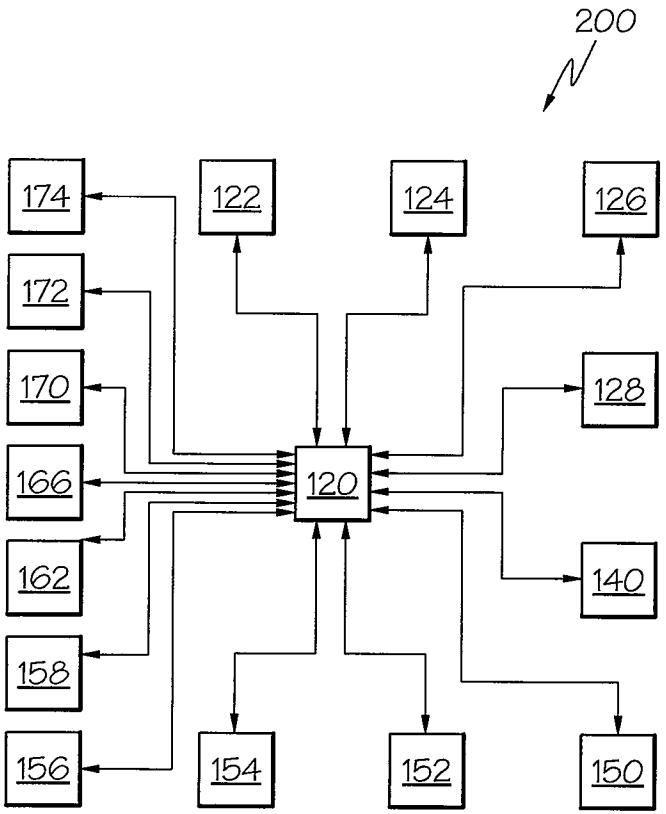
FIG. 4 schematically depicts a schematic of a physical assistive robotic system according to one or more embodiments shown and described herein.

Referring now to FIGS. 4 and 5, embodiments of a physical assistive robotic system 200, 201 may comprise an electronic control unit 120 that controls a plurality of operations. The electronic control unit 120 comprises a processor for executing machine readable instructions and an electronic memory 122 for storing machine readable instructions and machine readable information. The processor may be an integrated circuit, a microchip, a computer, or any other computing device capable of executing machine readable instructions. The electronic memory 122 may be RAM, ROM, a flash memory, a hard drive, or any device capable of storing machine readable instructions. In the embodiments described herein, the processor and the electronic memory 122 are integral with the electronic control unit 120. However, it is noted that the electronic control unit 120, the processor, and the electronic memory 122 may be discrete components communicatively coupled to one another without departing from the scope of the present disclosure. Furthermore it is noted that the phrase "communicatively coupled," as used herein, means that components are capable of transmitting data signals with one another such as for example, electrical signals via a conductive medium, electromagnetic signals via air, optical signals via optical waveguides, and the like.

As schematically depicted in FIG. 4, embodiments of the electronic control unit 120 integrate a multitude of modules and the operations associated with the modules. For example, one embodiment of the physical assistive robotic system 200 comprises an electronic control unit 120 communicatively coupled to: the electronic memory 122, the elevation actuator 124, the lateral actuator 126, the additional lateral actuator 128, the drive motor 140, the force sensing device 150, the additional force sensing device 152, the steering mechanism 154, the human machine interface 156, the navigation module 158, the base actuator 162, the footstep actuator 166, the wireless communicator 170, the posture detector 172, and the user-recognition module 174.

Referring again to FIG. 5, an alternative embodiment of the physical assistive robotic system 201 comprises an electronic control unit 120 communicatively coupled to: the electronic memory 122, the drive motor 140, the force sensing device 150, the additional force sensing device 152, the steering mechanism 154, the human machine interface 156, the navigation module 158, the base actuator 162, the footstep actuator 166, the wireless communicator 170, the posture detector 172, the user-recognition module 174, and the rotation actuator 206. Therefore, as described hereinabove, the embodiments of the present disclosure utilize the electronic control unit 120 to integrate a collection of modules to form a cohesive set of operations. Such cohesive operations will be described in more detail hereinafter.

Figure 6B:
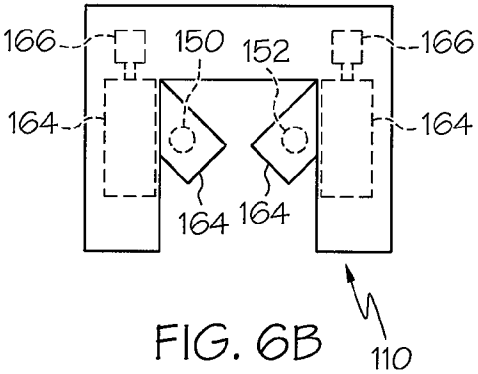
FIG. 6B schematically depicts a top view of a frame according to one or more embodiments shown and described herein.
Figure 6C:
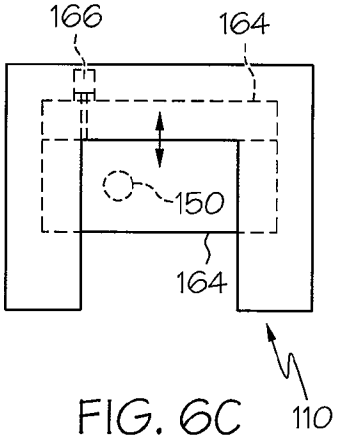
FIG. 6C schematically depicts a top view of a frame according to one or more embodiments shown and described herein.
Figure 6A:
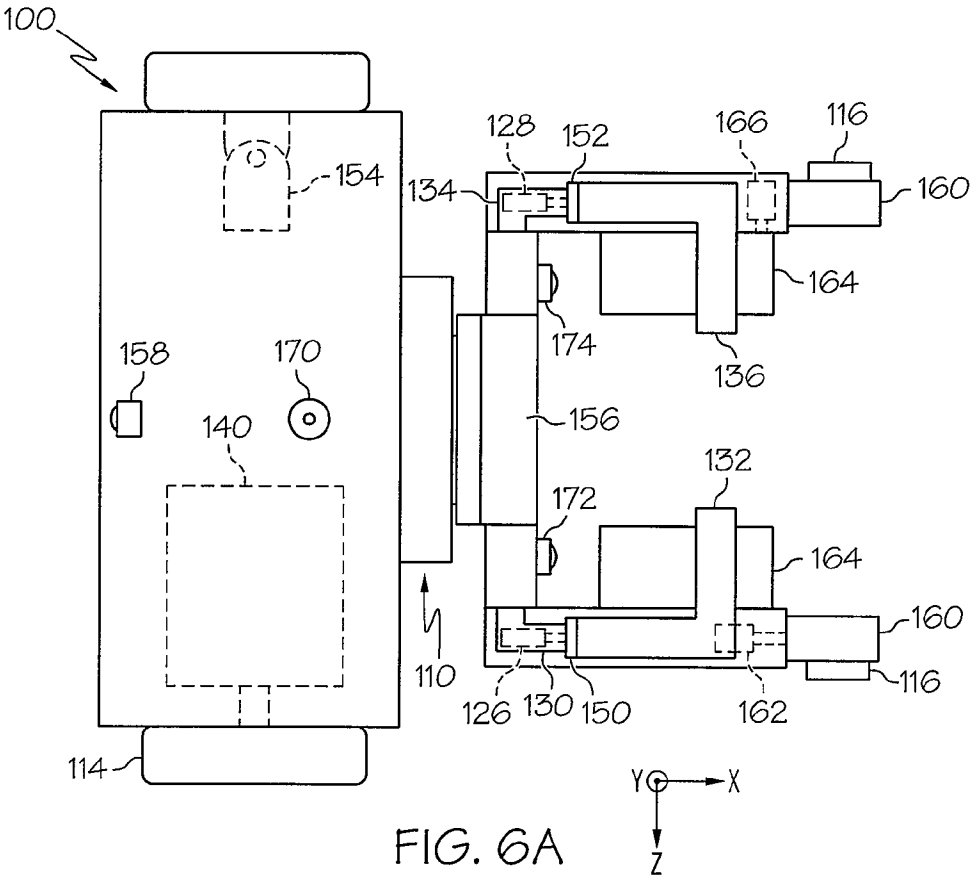
FIG. 6A schematically depicts a top view of a physical assistive robotic device according to one or more embodiments shown and described herein.

Referring now to FIG. 6A, a base member 160 and a base actuator 162, are schematically depicted. According to one embodiment, the base member 160 is slidably engaged with the frame 110. The base actuator 162 extends the base member 160 to provide a stabilizing structure, and retracts the base member 160 for a compact structure. The base actuator 162 is coupled to the frame 110 and the base member 160. In one embodiment, the base actuator 162 is a linear motor with a drive motor coupled to the frame 110 and an extension arm coupled to the base member 160. It is noted, that the term "slidably" as used herein means adjustable, or movable by sliding. Additional embodiments comprise a support wheel 116 rotatably coupled to the base member 160 to provide mobility. For example, the physical assistive robotic device 100 may comprise more than one support wheel 116 configured, for example, to support the frame 110.

Referring still to FIG. 6A, embodiments of the physical assistive robotic device 100 comprise an additional lateral member 134, an additional handle 136, and an additional lateral actuator 128 that transition the user between a standing position 180 (FIG. 3B) and a non-standing position 182 (FIG. 3A) by providing an additional mechanism to for the user to grab. In one embodiment, the elevation actuator 124 translates the additional lateral member 134 along the y-axis and the additional lateral actuator 128 translates the additional handle 136 along the x-axis. The additional lateral member 134 is slidably engaged with the upright support member 112, and the additional handle 136 is slidably engaged with the additional lateral member 134. The additional lateral member 134 and the additional handle 136 project away from the upright support member 112. The elevation actuator 124 is coupled to the upright support member 112 and the additional lateral member 134. The additional lateral actuator 128 is coupled to additional lateral member 134 and the additional handle 136. In one embodiment, the elevation actuator 124 may be a linear motor having a drive motor coupled to the upright support member 112 and the extension arm coupled to the lateral member 130 and the additional lateral member 134. The additional lateral actuator 128 is a linear motor with the drive motor coupled to additional lateral member 134 and the extension arm coupled to the additional handle 136. In another embodiment, multiple actuators are used in place of the elevation actuator 124. For example, each of the lateral member 130 and the additional lateral member 134 are coupled to a separate actuator for translation along the y-axis. In further embodiments, a single actuator may be used in place of the lateral actuator 126 and the additional lateral actuator 128. For example, an actuator may be coupled with gears and linkages to slidably translate the handle 132 and the additional handle 136 along the x-axis. In still further embodiments, a single actuator coupled with gears and linkages may provide actuation for the translation of the handle 132 and the additional handle 136 along the x-axis, and the translation of the lateral member 130 and the additional lateral member 134 along the y-axis. It is noted that the term "wheel," as used herein means an object with a circular cross-section arranged to revolve on an axis, such as, for example, a sphere, a disk, an omni wheel, a mecanum wheel and the like.

Referring now to FIGS. 1 and 2, embodiments of the present disclosure comprise a drive wheel 114 and a drive motor 140. The drive motor 140 rotates the drive wheel 114 to propel the physical assistive robotic device 100, 101. The drive wheel 114 is rotatably coupled to the frame 110. The drive motor 140 is coupled to the drive wheel 114 such that the drive motor 140 rotates the drive wheel 114. In one embodiment, the drive motor 140 is a battery powered electric motor that provides rotational energy to the drive wheel. In further embodiments, the drive motor 140 rotates multiple wheels to propel the device.

Embodiments of the physical assistive robotic device 100 may also comprise a steering mechanism 154 coupled to the frame 110, as depicted in FIG. 6A. The steering mechanism 154 directs the course of the physical assistive robotic device 100. While the steering mechanism 154 is depicted as a mechanical linkage for turning a wheel, it is noted that the steering mechanism 154 may be any device suitable for directing a device such as, for example, a rack and pinion, a recirculating ball mechanism, an omni wheel, a mecanum wheel and the like.

The frame 110 may also comprise a footstep 164 and a footstep actuator 166 that assists a user when riding the device by providing an ergonomic support for the user's foot, as schematically depicted in FIGS. 6A-6C. The footstep 164 may be movably engaged with the frame 110 and coupled to a footstep actuator 166. The footstep actuator 166 is coupled to the frame 110 and operates to stow or deploy the footstep 164. The footstep 164 stows by retracting within the frame 110. The footstep 164 may move transversely (FIGS. 6A and 6C) or rotate about an axis (FIG. 6B). In one embodiment, the frame 110 is moveably engaged with more than one footstep 164. In another embodiment, the footstep 164 is coupled to the frame 110 such that the footstep 164 remains in a substantially static position. In further embodiments, the footstep may comprise a force sensing device 150, an additional force sensing device 152 or a combination thereof, as will be described in more detail hereinafter.

Figure 7:
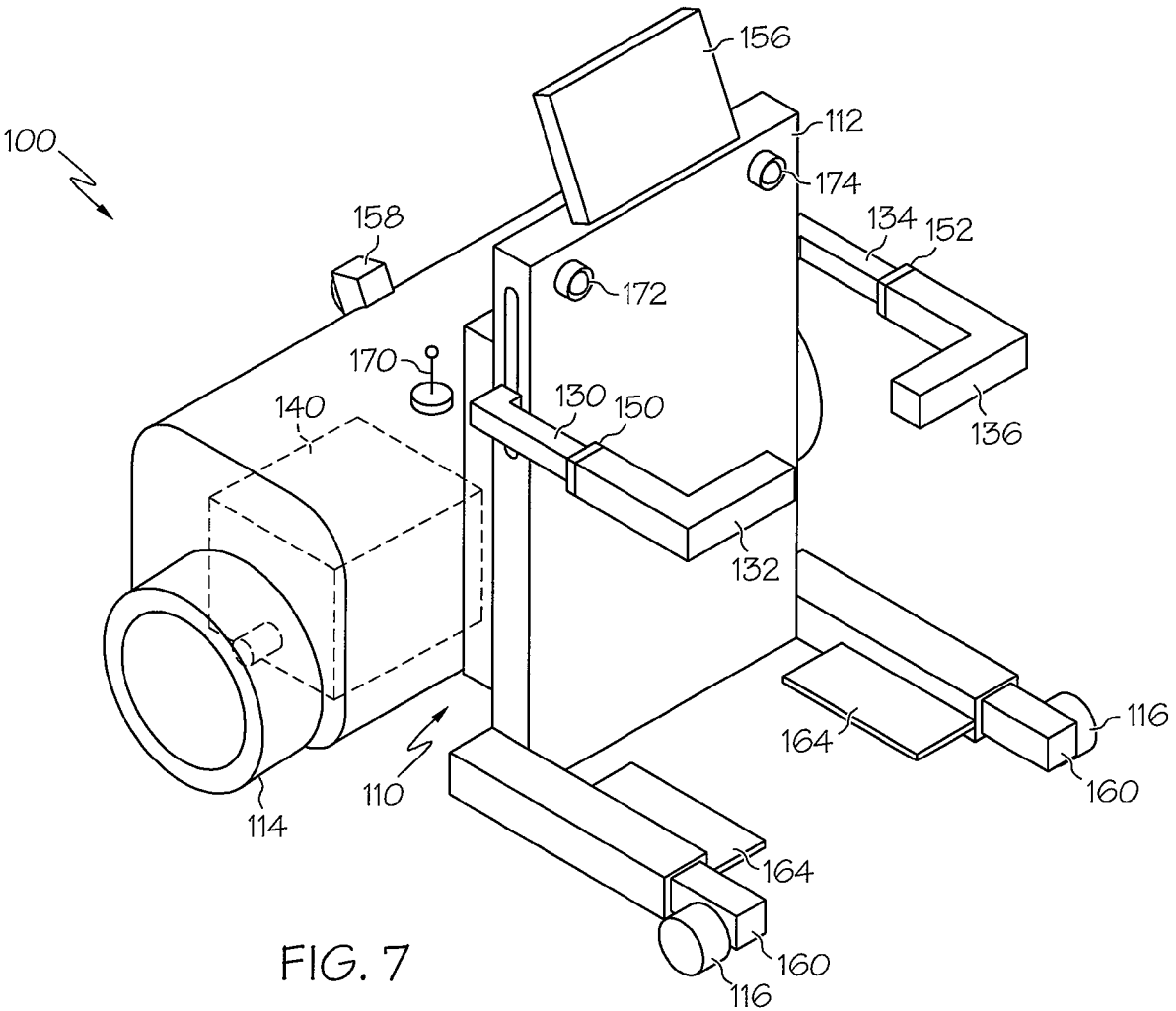
FIG. 7 schematically depicts a side perspective view of a physical assistive robotic device according to one or more embodiments shown and described herein.

Referring now to FIG. 7, further embodiments of the present disclosure may comprise a human machine interface 156 for interacting with a user. The human machine interface 156 may be coupled to the upright support member 112 and communicatively coupled with the electronic control unit 120. The human machine interface 156 receives destination information from the user and communicates the destination information to the electronic control unit. The electronic control unit 120 (FIGS. 4 and 5) executes machine readable instructions to store the destination information in the electronic memory 122, cause the drive motor 140 to rotate the drive wheel 114 based at least in part upon the destination information, and cause the steering mechanism 154 to steer based at least in part upon the destination information. For example, an embodiment of the human machine interface 156 is a touch screen. A user may enter information by selecting options displayed on the touch screen. When selecting a destination, a map is displayed and the user selects the desired information by touching the appropriate portion of the screen. Alternatively, a user can select the destination by typing the information using alphanumeric options displayed on the touch screen. While a touch screen is described herein, the human machine interface 156 may be any device that exchanges information with a user such as, for example, a monitor, a button, a switch, a speaker, a microphone or a speech recognition system.

Information specific to the user may also be entered via the human machine interface 156 and stored in the electronic memory 122. Such information, or user parameters, may be utilized by the electronic control unit 120 to customize the movement or functionality of the embodiments described herein. In one embodiment of the physical assistive robotic system 200, schematically depicted in FIG. 4, the electronic control unit 120 is communicatively coupled with the elevation actuator 124 and the lateral actuator 126 to transition a user between a standing position 180 and a non-standing position 182. At least one user parameter, such as for example, a height, a weight, a medical condition, and the like, is in a database where the at least one user parameter is associated with the identity of a user. The database is stored in the electronic memory 122 of the electronic control unit 120. Machine readable instructions for calculating an adjustable elevation rate based at least in part upon the at least one user parameter are also stored in the electronic memory. The electronic control unit 120 executes the machine readable instructions to retrieve the at least one user parameter from the database, set the adjustable elevation rate according to the machine readable instructions, and cause the elevation actuator 124 to translate the lateral member 130 according to the adjustable elevation rate. For example, when the elevation actuator 124 is assisting a frail user to a standing position 180 (FIG. 3B), the adjustable elevation rate may be set to a lower speed such as, but not limited to, by limiting the power delivered to the elevation actuator 124. Additionally, the power may be scaled according to the weight of the user, i.e., power is increased proportionally to an increase in weight. In this manner, the movements of the robotic human transport device 100 may be customized to the needs and desires of particular users.

Machine readable instructions for calculating an adjustable stop elevation based at least in part upon the at least one user parameter may also be stored in the electronic memory. In embodiments of the present disclosure, the electronic control unit 120 executes the machine readable instructions to retrieve the at least one user parameter from the database, set the adjustable stop elevation according to the machine readable instructions, and cause the elevation actuator 124 to position the lateral member at the adjustable stop elevation. For example, when the elevation actuator 124 is assisting a tall user to a standing position 180 (FIG. 3B) the adjustable stop elevation may be set to a relatively high location. Thus, the height of the adjustable stop elevation may be increased proportionally with an increase in height. In another embodiment, machine readable instructions for calculating an adjustable lateral rate based at least in part upon the at least one user parameter are also stored in the electronic memory. The electronic control unit 120 executes the machine readable instructions to retrieve the at least one user parameter from the database, set the adjustable lateral rate according to the machine readable instructions, and cause the lateral actuator 126 to translate the handle 132 according to the adjustable lateral rate. For example, when the lateral actuator 126 is assisting a frail user to a standing position 180 (FIG. 3B) the adjustable lateral rate may be set to a lower speed such as, but not limited to, by limiting the power delivered to the lateral actuator 126.

The physical assistive robotic device 100, schematically depicted in FIGS. 6A and 7, comprises a user recognition module 174 for recognizing the identity of a user. The user recognition module 174 may be coupled to the upright support member 112 and communicatively coupled with the electronic control unit 120. The user recognition module 174 senses the identity of the user and transmits an identification signal indicative of an identity of the user to the electronic control unit 120. The electronic control unit 120 executes machine readable instructions to receive the identification signal and store the identity in the electronic memory 122 (FIG. 4). The user recognition module 174 may be a barcode scanner, a facial recognition camera, a fingerprint scanner, a keyboard for receiving PIN data, and the like. In one embodiment, a barcode scanner is mounted to the upright support member 112 and is operable to read a barcode associated with an identity from a surface, such as, but not limited to, a patient identification wristband. The barcode scanner interprets the barcode and transmits information associated with the identity to the electronic control unit 120. Once the information is received, it may be used to locate the appropriate at least one user parameter, as described hereinabove.

Referring still to FIGS. 6A and 7, further embodiments of the physical assistive robotic device 100 comprise a posture detector 172 for recognizing a proper posture of a user. The posture detector 172 may be coupled to the upright support member 112 and communicatively coupled with the electronic control unit 120. The posture detector 172 transmits a posture signal indicative of a posture of the user to the electronic control unit 120. The electronic control unit 120 executes machine readable instructions to receive the posture signal and provide an alert of unsafe posture. Additionally, the electronic control unit 120 can cause other components communicatively coupled with the electronic control unit 120 to take corrective action in accordance with the detected posture, such as, for example, reducing operating power, shutting down in a controlled manner, or correcting the user's posture. In one embodiment, the electronic control unit 120 (FIGS. 4 and 5) causes the drive motor 140, which is communicatively coupled to the electronic control unit 120, to rotate the drive wheel 114 at a slower speed based upon the posture of the user. In another embodiment, the electronic control unit 120 causes the elevation actuator 124 to translate the lateral member 130 to alter the center of gravity of the user and correct an improper posture. In a further embodiment, the electronic control unit 120 causes the lateral actuator 126 to translate the handle 132 to alter the center of gravity of the user and correct an unsafe posture.

The posture detector 172 may be any type of computer vision system capable of identifying the posture of a user. For example, the posture detector 172 can utilize a camera to capture images of a user's head and shoulders to determine each body part's position and orientation relative to a reference coordinate system. This information can then be transmitted to the electronic control unit 120, where it is processed to determine whether the user's posture is proper. If an improper posture is detected an alarm may be provided to the user via a monitor, a touch screen, a speaker, a warning light, and the like. Furthermore, it is noted that the image data may be collected as a single image, multiple images or as a video.

Referring now to FIGS. 6A and 7, embodiments of the physical assistive robotic device 100 may also comprise a navigation module 158 to guide the user to a desired destination. The navigation module may be utilized in either a cooperative mode or an autonomous mode (described below) to provide positioning information to the electronic control unit 120 (FIGS. 4 and 5). The navigation module 158 is coupled to the frame 110 and communicatively coupled with the electronic control unit 120. The navigation module 158 communicates topographical information to the electronic control unit 120. The electronic control unit 120 executes machine readable instructions to cause the drive motor 140 to rotate the drive wheel 114 based at least in part upon the topographical information, and cause the steering mechanism 154 to steer the physical assistive robotic device 100 and 101 based at least in part upon the topographical information. As used herein the term "topographical information" means the features, relations, or configurations of a sensed area.

The navigation module 158 may include any number of sonar sensors, laser range finders, on-board cameras, and the like for sensing the topographical information. In one example, the electronic memory 122 (FIGS. 4 and 5) stores a map of a facility (e.g., a hospital comprising major landmarks and a destination). The navigation module 158 may utilize a sonar, infrared signals, radio frequency signals, etc. to detect the major landmarks. Detection information is then transmitted to the electronic control unit 120 (FIGS. 4 and 5) which determines a relative position of the system. Once the relative position is determined the drive motor 140 and the steering mechanism 154 are controlled by the electronic control unit and direct the system the destination. The detection and adaptation sequence is repeated until the destination is reached. It is noted that, the destination can be entered by a user or preprogrammed into the electronic memory 122.

In another embodiment of the present disclosure, the physical assistive robotic device 100 comprises a wireless communicator 170 that transmits a position signal indicative of the location of the physical assistive robotic device 100. The wireless communicator 170 may be any type of device that communicates wirelessly such as, for example, a radio, a personal area network device, a local area network device, a wide area network device, and the like. For example, a hospital may be equipped with a large area network, and the wireless communicator 170 may be a wireless network interface card. The wireless network interface card communicates with any device, such as a computer or a mobile device, connected to the local area network. Thus, the wireless communicator 170 may exchange information such as location, user parameter information, or any other data with devices connected to the network. For example, the wireless communicator 170 may receive topographic information or drive instructions that are transmitted from a server connected to the network.

Referring now to FIGS. 6A-7, embodiments of the present disclosure comprise a force sensing device 150 that provides a controlling mechanism for a user to operate embodiments of the present disclosure in a cooperative mode. The force sensing device 150 is communicatively coupled with the electronic control unit 120 (FIGS. 4 and 5), which executes machine readable instructions to set a cooperative mode or an autonomous mode.

When operating in the cooperative mode, the electronic control unit 120 causes the drive motor 140 to rotate the drive wheel 114 based at least in part upon a steering force detected by the force sensing device 150. In one embodiment, the force sensing device 150 (FIG. 6A) is disposed between the lateral member 130 and the handle 132 to sense a steering force applied to the handle 132. The user operates the physical assistive robotic system 200 by applying a steering force to the handle 132. The electronic control unit 120 responds to the sensed steering force by, for example, setting the rotational speed of the drive wheel 114 in proportion to the steering force detected by the force sensing device 150. Thus, with an increase in steering force sensed from the handle, the rotation speed of the drive wheel 114 is increased. For example, a user may walk while grasping the handle 132. The user's walking pace controls the rotational speed of the drive wheel 114. Similarly, a user may ride supported by the footstep 164 while grasping the handle 132. The magnitude of user's weight shift is detected by the force sensing device 150 and controls the rotation speed of the drive wheel 114. In another embodiment, the force sensing device 150 (FIG. 6C) is disposed on or within the footstep 164 to sense a steering force applied to the footstep 164. The user operates the physical assistive robotic system 200 by applying a steering force to the footstep 164 to control the rotation speed of the drive wheel 114. For example, a user may ride supported by the footstep 164 while applying a steering force to the force sensing device 150, e.g. by shifting weight. Thus, as described above, the force sensing device 150 controls the speed. Such speed control can be supplemented with the navigation module 158 and the steering mechanism 154 that guide the physical assistive robotic system 200 along a course while the user controls the speed.

Further embodiments comprise an additional force sensing device 152 communicatively coupled to the electronic control unit 120. In one embodiment, the additional force sensing device 152 (FIG. 6A) is disposed between the additional lateral member 134 and the additional handle 136 to sense a steering force applied to the additional handle 136. In another embodiment, the additional force sensing device 152 (FIG. 6B) is disposed on or within the footstep 164 to sense a steering force applied to the footstep 164. The user steers the steering mechanism 154 by applying different amounts of steering force to the force sensing device 150 and the additional force sensing device 152. For example, the electronic control unit 120 responds to the different amounts of steering force by causing the steering mechanism 154 to turn the physical assistive robotic system 200.

When operated in the autonomous mode, the electronic control unit 120 causes the drive motor 140 to rotate the drive wheel 114 to autonomously propel the physical assistive robotic device 100. For example, the physical assistive robotic system 200 may automatically transport a user to a destination that is stored in the electronic memory 122. The electronic control unit 120 executes machine readable instructions to compare the destination to topographical information and determine the appropriate sequence of operations to reach the destination. The drive motor 140 and the steering mechanism 154 are directed by the electronic control unit 120 to proceed towards the destination. The physical assistive robotic system 200, 201 may autonomously transport a user to the destination.

Referring now to FIGS. 1, and 3A-3C, embodiments of the present disclosure transition a user between a standing position 180 and a non-standing position 182. For example, one embodiment of the physical assistive robotic system 200 autonomously navigates to the bedside of a user (FIG. 1). The user grasps the handle 132 while in a non-standing position 182. The lateral actuator 126 (FIG. 3A) translates the handle 132 along the x-axis towards the upright support member 112 and shifts the user's center of gravity forward. The base actuator 162 (FIG. 3A) translates the base member 160 along the x-axis away from the upright support member 112. The elevation actuator 124 (FIG. 3B) translates the lateral member 130 along the y-axis and assists in lifting the user to a standing position 180. After the user is guided to a desired destination (FIG. 3C), as described hereinabove, the lateral actuator 126 translates the handle 132 along the x-axis away from the upright support member 112 and shifts the user's center of gravity backwards. The elevation actuator 124 translates the lateral member 130 along the y-axis and assists in lowering the user to a non-standing position 182. It is noted that, while the transitions between the standing position 180 and the non-standing position are described as sequential, the operation of the elevation actuator 124 and the lateral actuator 126 may occur in any order or simultaneously without departing from the scope of the present disclosure.

Referring now to FIGS. 2 and 5, alternative embodiments of the physical assistive robotic system 201 comprise a rotation actuator 206 communicatively coupled with the electronic control unit 120. The electronic control unit 120 executes machine readable instructions to cause the rotation actuator 206 to rotate the radial support member 208 to transition a user between a standing position 180 and a non-standing position 182. For example, when the torso support member 210 is in contact with the torso of a user force is transferred from the user to the radial support member 208. As the radial support member 208 rotates towards the upright support member 112, the user is required to expend less energy to transition from a non-standing position 182 to a standing position 180. Similarly as the radial support member 208 rotates away from the upright support member 112, the user is required to expend less energy to transition from a standing position 180 to a non-standing position 182. As used herein the term "standing" means having an upright posture with a substantial portion of weight supported by a foot.

It should now be understood that the embodiments described herein relate to physical assistive robotic devices and systems. The embodiments provide mobility to individuals by providing mechanisms and autonomous operations that assist with sitting, standing and walking. Sitting and standing assistance is provided by actuated mechanisms that transition a user between standing and non-standing positions. Additionally, walking is promoted by providing a cooperative mode and an autonomous mode. Each of the modes provide the user with physical support. Further mobility is provided to the user by riding structure and autonomous operations that carry a user to a desired destination.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A physical assistive robotic system comprising:

an electronic control unit comprising a processor for executing machine readable instructions and an electronic memory for storing the machine readable instructions;

a frame comprising an upright support member;

a radial support member rotatably engaged with the frame;

a torso support member coupled to the radial support member;

a rotation actuator coupled to the frame and the radial support member, and communicatively coupled with the electronic control unit;

a lateral rotation housing rotatably engaged to the upright support member of the frame and coupled to the rotation actuator; and a lateral rotation member slidably engaged with the lateral rotation housing such that the lateral rotation member is configured to slidably translate relative to the lateral rotation housing, wherein the lateral rotation member is coupled to the rotation actuator and the radial support member, wherein the electronic control unit executes the machine readable instructions to cause the rotation actuator to slidably translate the lateral rotation member relative to the lateral rotation housing, thereby rotating the radial support member to transition a user between a standing position and a non-standing position.

2. The physical assistive robotic system of claim 1, wherein the radial support member is rotatably engaged with the frame and projects vertically from the frame to the torso support member.

3. The physical assistive robotic system of claim 2, wherein the torso support member is padded.

4. The physical assistive robotic system of claim 1, wherein the torso support member is contoured to support a torso of the user.

5. The physical assistive robotic system of claim 1, further comprising:

a footstep movably engaged with the frame; and a footstep actuator coupled to the frame and the footstep, and communicatively coupled with the electronic control unit, wherein the electronic control unit executes the machine readable instructions to cause the footstep actuator to stow or deploy the footstep.

6. The physical assistive robotic system of claim 1, further comprising:

a base member slidably engaged with the frame; and a base actuator coupled to the frame and the base member, and communicatively coupled with the electronic control unit, wherein the base actuator translates the base member.

7. The physical assistive robotic system of claim 1, further comprising:

a drive wheel rotatably coupled to the frame; and a drive motor coupled to the drive wheel, and communicatively coupled to the electronic control unit, wherein the drive motor rotates the drive wheel.

8. A physical assistive robotic system comprising:

an electronic control unit comprising a processor for executing machine readable instructions and an electronic memory for storing the machine readable instructions;

a frame comprising an upright support member;

a radial support member rotatably engaged with the frame;

a torso support member coupled to the radial support member;

a rotation actuator coupled to the frame and the radial support member, and communicatively coupled with the electronic control unit;

a drive wheel rotatably coupled to the frame;

a drive motor coupled to the drive wheel, and communicatively coupled to the electronic control unit, wherein the drive motor rotates the drive wheel;

a support wheel rotatably coupled to the frame;

a steering mechanism coupled to the frame and communicatively coupled with the electronic control unit; and a navigation module coupled to the frame and communicatively coupled with the electronic control unit, wherein:

the navigation module communicates topographical information to the electronic control unit; and the electronic control unit executes the machine readable instructions to:

cause the drive motor to rotate the drive wheel based at least in part upon the topographical information;

cause the steering mechanism to steer the physical assistive robotic system based at least in part upon the topographical information; and cause the rotation actuator to rotate the radial support member to transition a user between a standing position and a non-standing position.

9. The physical assistive robotic system of claim 8, wherein the electronic control unit executes the machine readable instructions to:

set an autonomous mode; and cause the drive motor to rotate the drive wheel to autonomously propel the physical assistive robotic system when the physical assistive robotic system is operated in the autonomous mode.

10. A physical assistive robotic system comprising:

an electronic control unit comprising a processor for executing machine readable instructions and an electronic memory for storing the machine readable instructions;

a frame comprising an upright support member;

a drive wheel rotatably coupled to the frame;

a support wheel rotatably coupled to the frame;

a drive motor coupled to the drive wheel and communicatively coupled with the electronic control unit; and a force sensing device communicatively coupled with the electronic control unit for detecting a steering force, wherein the electronic control unit executes the machine readable instructions to:

set a cooperative mode or an autonomous mode;

cause the drive motor to rotate the drive wheel based at least in part upon the steering force detected by the force sensing device when the physical assistive robotic system is operated in the cooperative mode; and cause the drive motor to rotate the drive wheel to autonomously propel the physical assistive robotic system when the physical assistive robotic system is operated in the autonomous mode.

11. The physical assistive robotic system of claim 10, further comprising:

a base member slidably engaged with the frame; and a base actuator coupled to the frame and the base member, and communicatively coupled with the electronic control unit, wherein the base actuator translates the base member.

12. The physical assistive robotic system of claim 10, further comprising:

a footstep movably engaged with the frame; and a footstep actuator coupled to the frame and the footstep, and communicatively coupled with the electronic control unit, wherein the electronic control unit executes the machine readable instructions to cause the footstep actuator to stow or deploy the footstep.

13. The physical assistive robotic system of claim 10, further comprising a footstep, wherein the force sensing device is disposed on the footstep or within the footstep.

14. The physical assistive robotic system of claim 10, further comprising a steering mechanism coupled to the frame and communicatively coupled with the electronic control unit, wherein the electronic control unit executes the machine readable instructions to:

store destination information in the electronic memory;

cause the drive motor to rotate the drive wheel based at least in part upon destination information; and cause the steering mechanism to steer the physical assistive robotic system based at least in part upon the destination information.

15. The physical assistive robotic system of claim 14, further comprising a navigation module coupled to the frame and communicatively coupled with the electronic control unit, wherein the electronic control unit executes the machine readable instructions to:

receive topographical information from the navigation module;

cause the drive motor to rotate the drive wheel based at least in part upon the topographical information; and cause the steering mechanism to steer the physical assistive robotic system based at least in part upon the topographical information.

16. The physical assistive robotic system of claim 10, further comprising:

a radial support member rotatably engaged with the frame;

a torso support member coupled to the radial support member; and a rotation actuator coupled to the frame and the radial support member, and communicatively coupled with the electronic control unit, wherein the electronic control unit executes the machine readable instructions to cause the rotation actuator to rotate the radial support member to transition a user between a standing position and a non-standing position.

17. The physical assistive robotic system of claim 10, further comprising:

a lateral member slidably engaged with the upright support member; and a handle slidably engaged with the lateral member, wherein the force sensing device is disposed between the lateral member and the handle.

18. The physical assistive robotic system of claim 17, further comprising:

an elevation actuator coupled to the upright support member and the lateral member; and a lateral actuator coupled to the lateral member and the handle, wherein the elevation actuator translates the lateral member and the lateral actuator translates the handle to transition a user between a standing position and a non-standing position.

19. The physical assistive robotic system of claim 18, further comprising:

an additional lateral member slidably engaged with the upright support member and coupled to the elevation actuator;

an additional handle slidably engaged with the additional lateral member; and an additional lateral actuator coupled to the additional lateral member and the additional handle wherein, the elevation actuator translates the additional lateral member and the additional lateral actuator translates the additional handle to transition the user between the standing position and the non-standing position.

* * * * *